US005239277A

United States Patent [19]

Vielot

[11] Patent Number: 5,239,277

[45] Date of Patent: Aug. 24, 1993

[54] ELECTROMAGNETIC SOLENOID ACTUATOR

[75] Inventor: Jacques Vielot, Southfield, Mich.

[73] Assignee: Magnetic Technology, Incorporated, Southfield, Mich.

[21] Appl. No.: 782,141

[22] Filed: Oct. 28, 1991

[51] Int. Cl.[5] ..... H01F 7/08

[52] U.S. Cl. ..... 335/255; 335/279

[58] Field of Search ..... 335/255, 258, 261, 262, 335/279

[56] References Cited

U.S. PATENT DOCUMENTS 5,010,312 4/1991 Motykiewicz ..... 335/261

*Primary Examiner*—Harold Broome

[57] ABSTRACT

A d-c electromagnetic solenoid designed to open or close circuit breakers, for operating valves, and any other applications which a relatively large force is applied to a member which moves a relatively short distance through the conversion of electrical energy into optimum mechanical work from magnetic attraction. It consists of a circular stationary coil(s) of conducting wire(s) wound around a nonmagnetic spool with a hollow core in which a nonmagnetic circular bushing or guide is tightly fitted to guide the symetrical sliding motion of a mushroom or T-shaped plunger along the central axis, the plunger is of circular shaped with a diametrically enlarged step made of magnetic material designed to slide axially through the guide under the influence of the exiting coil(s), a positive stop of magnetic material, a cylindrical shell of magnetic material to carry the external flux serves as well as a housing for the assembly, a cover made of nonmagnetic material limits the upward travel of the plunger and create a large air gap in the external flux path, a spring (or any other device or air or fluid and the like) designed to hold the plunger in its original position before the excitation of the current carrying coil(s) and to return it to its original position once the coil(s) is de-energized.

3 Claims, 2 Drawing Sheets

ELECTROMAGNETIC SOLENOID ACTUATOR

BACKGROUND OF THE INVENTION

1. Technical Field

The field of art to which this invention pertains may be generally located in the class of devices relating to electromagnet and in particular to solenoid actuator which actuates mechanically a valve or piston or the like.

2. Background Information

As is known, the extremely widespread use of solenoids in many fields of electrical technology, automatic controls is due to the versatility of the numerous types provided. In particular, the trend of manufacturing of electrical devices, which currently use miniaturized electromagnetic apparatuses, is to reduce their dimensions and make them as compact as possible as well as more energy efficient.

In view of the above, solenoids manufacturers are therefore induced to manufacture solenoids that have smaller dimensions, especially in terms of length, and are increasingly sensitive, i.e, have a lower power consumption so as to reduce the dimensions of the power supply.

The problems encountered in the prior art solenoid is that the theoretical foundation guiding every area of their engineering is dated. The operation and limitations of electromagnetic devices and machinery based on the fundamental laws of electromagnetism, electromagnetic force relations, and all the limitations ascribed to the supposedly low permeability of magnetic materials, the excessive use of conducting wire(s), the relatively slow speed of action of the plunger and low magnetic efficacy resulting from the misconception that the available mechanical work is directly proportional to the bulk or weight of the magnet, which ignores the added effect tangential forces in the direction of the magnetic field intensity, the costly machining, fabricating and assembly methods required to improve efficacy, notwithstanding the high cost of high permeability ferromagnetic materials, all of which remain unsolved.

Previous efforts have been made in an attempt to increase the homogeneity of magnetic fields by devising new coils such as that of Gottfried J. Krueger, Reno di Leggiuno, Italy, U.S. Pat. No. 4,231,008, or by adding a permanent magnet circuit to the electromagnetic field as that of Tokie Uetsuhara, Urawa, Japan, U.S. Pat. No. 4,797,645, dated Jan. 10, 1989.

Whatever the precise merits, features and advantages of the above cited references, none of them achieves or fulfills the purposes of the current solenoid actuator.

3. Description of the Prior Art.

An example of a prior art electromagnetic solenoid actuator is described with reference to FIG. 1, which is one of the drawings indicated in the "brief description of the drawings" set forth later. The electromagnetic solenoid actuator of FIG. 1 comprises a magnetic circuit having a space energized by coil (11); a movable element (14) made of magnetic material which is inserted between pole face (12*a*) and (12*b*) of the stationary element (12) through a first gap (13), the movable element (14) can be mechanically moved in the direction represented by the arrow (14*a*) and (14*b*) moving with both the pole (12*a*) and (12*b*) at right angle, and a permanent magnet (16) fixed to a yoke (17) of the stationary element (12), the pole faces of the same polarity of the permanent magnet (16) are faced to the side surface of the movable element (14) through a small second gap (15).

In the electromagnetic solenoid actuator of FIG. 1, all the above mentioned demerits are present. Furthermore, the manufacturing process of combining a permanent magnet with an electromagnet is cumbersome. This type of solenoid actuator is designed on the basis of the misconception that the available mechanical work is directly proportional to the weight of the magnet and the magnetic efficacy can not be made greater than fifty percent.

SUMMARY OF THE PRESENT INVENTION

With these demerits in mind, it is the primary object of the present invention to provide an electromagnetic solenoid actuator of simple, compact and hardy structure, that benefits from the tangent component forces, and that can operate at high speed and with high sensitivity while simultaneously increasing significantly the magnetic pull force.

Referring to FIG. 2, there is shown a schematic illustration showing the principle of the electromagnetic solenoid actuator of the present invention. No device of the prior art is known to have the geometric features of the present invention or rooted in the theoretical relations that it postulates.

In fulfillment and implementation of the previously recited objects, a primary feature of the invention resides in the provision of a uniquely designed step diametrically enlarged plunger (5). Coil (9) efficiency is improved so that a maximal magnetomotive force is produced from a relatively small amount of electrical power. The magnetic-to-mechanical energy conversion process is improved to provide comparable mechanical force at greatly reduced level of stored magnetic energy. The present invention is directed to a solenoid actuator or which is adapted to push or pull, given the application, a variety of circuits, valves or tripping mechanisms. The present invention is directed at applying the new theory of the effect of tangent component forces in a heterogeneous magnetic field to increase the sensitivity, to reduce the mass and size of the electromagnet, to increase the magnetic pull power beyond the supposed limit stated by classical mechanical theories and mentioned above, to reduce the magnetomotive force, to reduce the power consumption, to increase the efficiency of operation and to reduce manufacturing cost. The present invention is adapted to the prior art's manufacturing materials and technics. The theoretical fundation of the present invention is outlined in Jacques Vielot's Electromagnetic Relay, U.S. patent application Ser. No. 07/745,595, dated May 22, 1992.

DESCRIPTION OF THE PREFERRED EMBODIMENT

Figure 1:
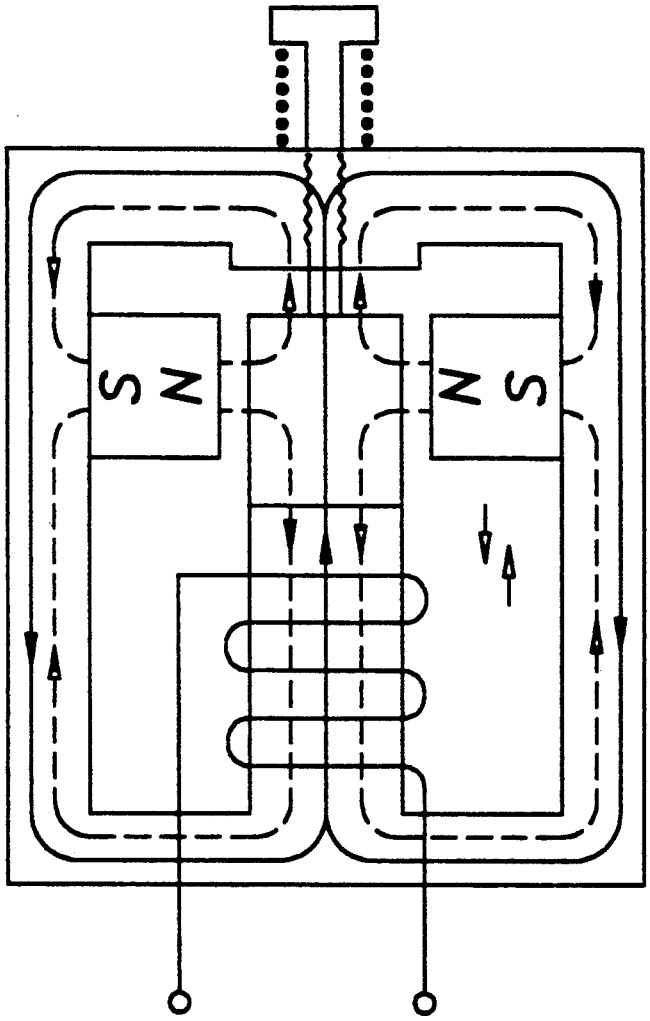
FIG. 1 PRIOR ART
FIG. 1 illustrates an example of a prior art electromagnetic solenoid actuator.
Figure 2:
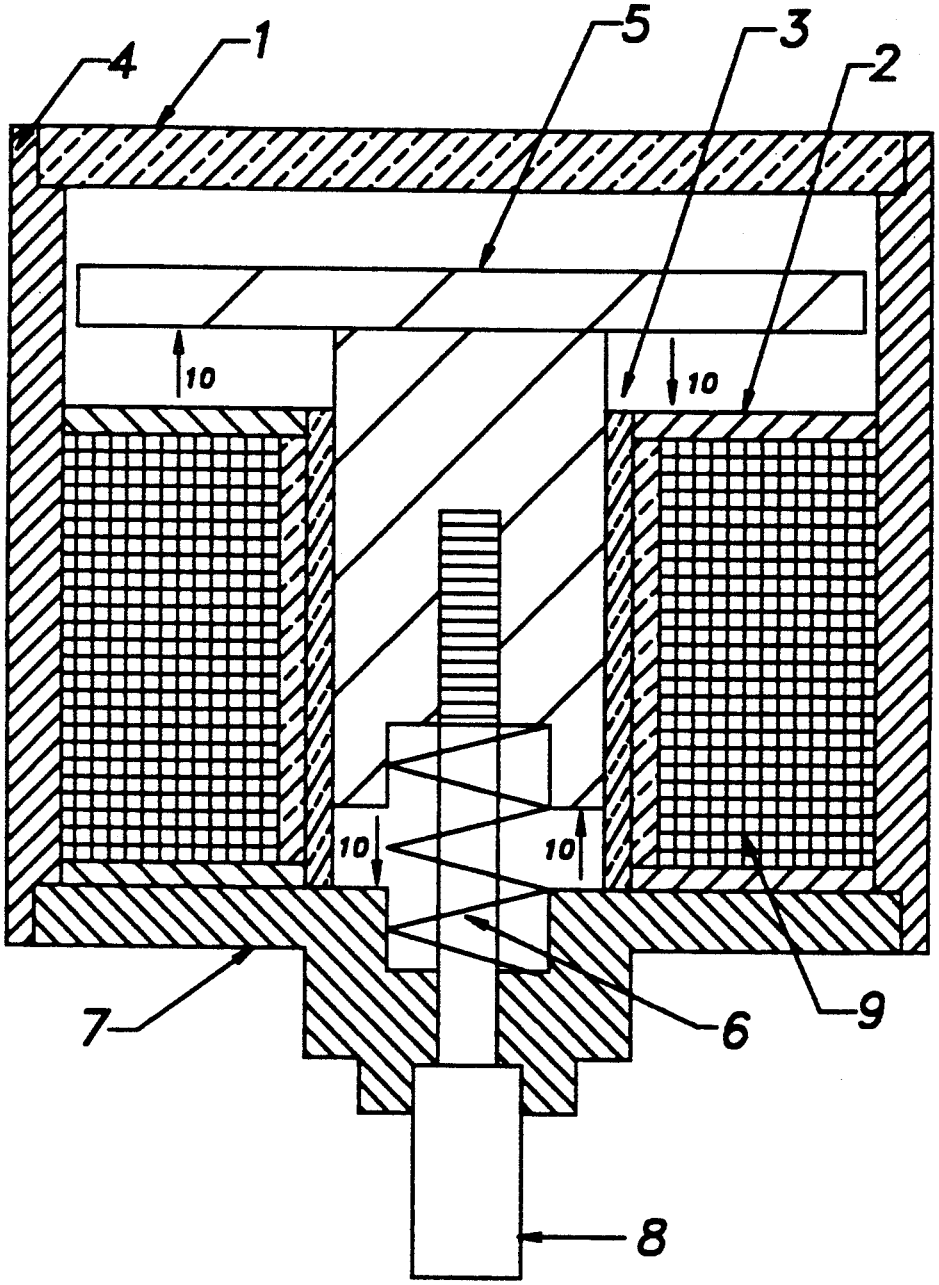
FIG. 2 illustrates an electromagnetic solenoid actuator according to the embodiment of the present invention.

An electromagnetic solenoid actuator according to an embodiment of the present invention is illustrated in FIG. 2. In this embodiment it is composed of a circular coil (9) of rectangular crossection allowing for a three-squares geometry to achieve maximum compactness, to be hardy and for optimum dimensional proportionality given the functional mechanical requirements. The coil assembly can be insulated, made shockproof and fireproof if sealed inside a plastic injected molding enclosure or the like to assure complete environmental protection if the solenoid application involves immersion in water or other fluids that can cause corrosion or shorten the electrical circuit, without affecting it adversely. A typically diametrically ehlarged stepped plunger (5) of circular crossection whose size and mass are determined by the tangent component force requirement slides with a slip-fit assembly vertically in nonmagnetic guide(s), brass or the like, inside the coil. This configuration provides for minimum leakage flux and fringing flux which are redirected tangentially in the direction of the field intensity in the large air gap (10), reduce friction linearly and proportionally to the increased rate of acceleration, and reduced moments of inertia that make for a faster and more powerful solenoid whose ultimate mechanical force is far greater than that which is achievable on the basis of the prior art theory and design. The plunger and coil is surrounded by a cylindrically shaped shell (4) made of magnetic material in which the coil spool is pressed fit to location given the range of travel of the plunger and to provide the flux path for the magnetic field. A circular positive stop (7) of magnetic material fitted at the bottom of the shell provides a location for the restoring spring, or like mechanism, designed to support the plunger in its original position and to return it to its original position once the coil is deenergized. A top or cover piece (1) of circular shape made of nonmagnetic material that serves to limit the upward travel of the plunger by the restoring sping, an adjusting screw or like mechanism. An extension pin (8) centers the plunger and provides added linearity to its active movement longitudinally and the required active force externally. Good thermal contact and heat dissipation characteristics are assured by the mating of the coil spool (2),

Availability for Industry

As explained above, the present invention is effectively utilized for an electromagnetic valve, electromagnetic piston, electromagnetic locking device, electromagnetic actuated doors, switch operating mechanism or various industrial and private use. In the first embodiment the assembled electromagnetic actuator, as illustrated in FIG. 2, measures 50 mm in diameter and 45 mm in height with an electric power of 37 Watts d-c of continuous duty it is capable of generating the propulsive force of 52 kg and stroke of 5 mm.

In practice, the materials employed, as well as the dimensions, may be any according to the requirements and to the state of the art.

What is claimed is:

1. A compact electromagnetic solenoid actuator comprising:

a mushroom or T-shaped plunger having an enlarged diameter portion and a reduced diameter portion, a stationary electromagnetic coil with three square geometry wound about a bobbin; said coil having a diameter equal to three times the reduced diameter of the plunger with the winding length equal to the length dimension of said reduced diameter of the plunger;

a cylindrical shell enclosing the coil and plunger, the enlarged diameter outer surface being the primary working surface, is in substantially close proximity to the shell to increase the flux path area for the tangent component forces whose greater homogeneity combine with the normal forces acting axially to increase the resulting mechanical force for a given flux density; said enlarged diameter portion of the plunger extends above the coil bobbin for a given stroke;

said reduced diameter portion of the plunger extends axially inside the coil bobbin to a distance near the bottom of said bobbin;

a restoring spring and a magnetic stop located at one end of the actuator in the direction of force;

said restoring spring holding the plunger in its original position returning said plunger to that position when the coil is deenergized;

an extension pin secured to the plunger conveys the active force externally;

a nonmagnetic plate is located at the end of the actuator opposite to that of the stop;

said cylinderical magnetic shell that houses the actuator closes the magnetic flux path.

2. A high speed electromagnetic solenoid actuator comprising:

a stationary electromagnetic coil of rectangular crossection wound about a bobbin;

a movable plunger having an enlarged portion made of magnetic material slides axially inside the electromagnetic coil, characterized in that said plunger enlarged portion greatly increased flux distribution capability and maximizes the tangent component working force causing sharply increased rate of acceleration of the moving plunger;

a magnetic stop located at the end of the coil in the direction of the force;

a nonmagnetic plate located at the end of the assembly opposite tbat of the magnetic stop;

a restoring spring supported by the magnetic stop;

an extension pin secured to the plunger for conveying the active force externally;

a cylindrical shell enclosing said coil and said plunger to close the magnetic flux path.

3. A light weight electromagnetic solenoid actuator comprising:

a stationary electromagnetic coil of rectangular crossection with three square geometry wound about a bobbin;

a movable plunger having an enlarged portion and made of magnetic material moves axially inside the coil the enlarged portion of the plunger providing substantial flux carrying capability extending above the coil to a stroke permitting a substantial reduction in diameter and length of a reduced portion of the plunger that extends axially inside the coil thereby reducing the overall size and weight the electromagnet;

a restoring spring, a magnetic stop located at the bottom of the bobbin in the direction of a force provides support for the restoring spring;

said restoring spring supports the plunger in its original position and return said plunger to that position when the coil is deenergized;

a nonmagnetic plate located at the end opposite the direction of the force;

a cylindrical magnetic shell surrounding the coil and plunger to close the magnetic flux path.

* * * * *